US010398613B2

(12) United States Patent
Harburg et al.

(10) Patent No.: US 10,398,613 B2
(45) Date of Patent: Sep. 3, 2019

(54) PATIENT SUPPORT DEVICE AND RELATED METHOD OF USE

(71) Applicant: Spectrum Health Innovations, LLC, Grand Rapids, MI (US)

(72) Inventors: Mark W. Harburg, Ann Arbor, MI (US); Franz C. Narowski, Ann Arbor, MI (US); Michael A. Johnson, West Olive, MI (US); Kade A. Roggentine, Byron Center, MI (US)

(73) Assignee: Spectrum Health Innovations, LLC, Grand Rapids, MI (US)

( * ) Notice: Subject to any disclaimer, the term of this patent is extended or adjusted under 35 U.S.C. 154(b) by 366 days.

(21) Appl. No.: 15/429,550

(22) Filed: Feb. 10, 2017

(65) Prior Publication Data

US 2017/0239113 A1 Aug. 24, 2017

Related U.S. Application Data

(60) Provisional application No. 62/298,176, filed on Feb. 22, 2016.

(51) Int. Cl.
*A61G 7/07* (2006.01)
*A61G 7/075* (2006.01)

(52) U.S. Cl.
CPC ..... *A61G 7/07* (2013.01); *A61G 7/0755* (2013.01)

(58) Field of Classification Search
CPC ..... A61G 7/07
USPC ..... 5/632, 633, 81.1 R
See application file for complete search history.

(56) References Cited

U.S. PATENT DOCUMENTS

| | | | |
|---|---|---|---|
| 1,151,891 | A | 8/1915 | Meinecke |
| 1,361,042 | A | 12/1920 | Fuller |
| 1,365,223 | A | 1/1921 | Bums |
| 1,809,392 | A | 6/1931 | Ponten et al. |
| 1,902,249 | A | 3/1933 | Lanzy |
| 1,949,113 | A | 2/1934 | Cox |
| 2,105,336 | A | 1/1938 | Smith |
| 2,250,026 | A | 7/1941 | Laukhuff |
| 2,448,924 | A | 9/1948 | Smith |

(Continued)

FOREIGN PATENT DOCUMENTS

EP 0891729 1/1999

OTHER PUBLICATIONS

Compilation of Prior Art Supports (Sep. 25, 2015).

*Primary Examiner* — Fredrick C Conley
(74) *Attorney, Agent, or Firm* — Warner Norcross + Judd LLP

(57) ABSTRACT

A device and related method for supporting a patient in an upright, seated position during a treatment, for example, during a physical therapy session is provided. The support device can include a base frame, a support arm, a center bolster and a back support pivotally joined with the base frame and/or the center bolster so that the center bolster is supported in an upright position by the base frame. The base frame can be configured to secure to a support structure thereby preventing the device from sliding across a surface of a support bed on which a patient is disposed. Lateral bolsters can be joined with the center bolster and/or base frame to laterally stabilize the patient. The device can be void of a seat bottom disposed under the patient. The related method can include steps of using the device.

20 Claims, 11 Drawing Sheets

(56) References Cited

U.S. PATENT DOCUMENTS

| | | | | |
|---|---|---|---|---|
| 2,489,693 | A | 11/1949 | Williams | |
| 2,496,592 | A | 2/1950 | Morgan | |
| 2,521,412 | A | 9/1950 | Sack | |
| 2,529,350 | A | 11/1950 | Posz | |
| 2,542,820 | A | 2/1951 | Legois | |
| 2,545,849 | A | 3/1951 | Browne | |
| 2,740,466 | A | 4/1956 | Priest | |
| 2,802,220 | A | 8/1957 | Locke | |
| 2,867,821 | A | 1/1959 | Bolton | |
| 3,030,639 | A | 4/1962 | Boyer | |
| 3,170,199 | A | 2/1965 | Martin | |
| 3,217,341 | A | 11/1965 | Levy | |
| 3,230,557 | A | 1/1966 | Hale | |
| 3,343,185 | A | 9/1967 | Nemser | |
| 3,522,616 | A | 8/1970 | Saldo et al. | |
| 3,606,623 | A | 9/1971 | Aymar | |
| 3,866,250 | A | 2/1975 | Bradford | |
| 3,895,840 | A | 7/1975 | Szurszewski | |
| 4,185,342 | A | 1/1980 | Young | |
| 4,660,237 | A | 4/1987 | Brodnax | |
| 5,046,206 | A | 9/1991 | Broyles | |
| 5,765,244 | A * | 6/1998 | Heidler | A47C 20/027 5/630 |
| 5,829,837 | A | 11/1998 | Reiersen | |
| 5,926,876 | A * | 7/1999 | Haigh | A61G 13/12 5/616 |
| 6,564,406 | B2 * | 5/2003 | Vansteenburg | A61G 13/12 5/621 |
| 7,328,470 | B2 | 2/2008 | Harris, Jr. et al. | |
| D641,563 | S | 7/2011 | Matteson et al. | |
| 8,517,468 | B2 | 8/2013 | Scott-Groveveldt | |

* cited by examiner

PATIENT SUPPORT DEVICE AND RELATED METHOD OF USE

BACKGROUND OF THE INVENTION

The present invention relates to physical therapy, and more particularly to a device and related method for supporting a patient in an upright, seated position during a treatment, for example, during a physical therapy session.

In hospital and nursing home settings, patients can be immobilized to the point that they become at least temporarily bedridden. In such cases, it can be desirable for a healthcare provider to support the patient in an upright configuration on the side of the patient's bed. Such an upright configuration can be helpful, particularly during the administration of physical therapy to the patient.

Weak, elderly and disabled patients typically lack the core muscle strength to support themselves for any duration of time in the upright, sitting configuration on the side of the patient's bed. Further, there currently is no structural stabilization or back support for the patient when sitting in the upright configuration. This can result in the patient falling backward, or to the side, when the healthcare provider, such as a physical therapist, performs therapy on or exercises with the patient. In extreme cases, the patient fall can lead to accidental and unintended injuries, which can mount additional healthcare costs.

In an attempt to solve this problem, hospitals use extra healthcare providers to support the patient, effectively holding them in the upright sitting configuration by applying a manual force to the patient's back. While the extra healthcare provider supports the patient, another healthcare provider administers the treatment, such as physical therapy to the patient. Oftentimes, this results in additional labor costs to provide the extra healthcare provider.

Where the extra healthcare provider is not available, the primary healthcare provider administering the treatment may have to support the patient themselves. Frequently, this results in the provider not being able to complete all of the intended activities with the patient. Some creative healthcare providers and/or therapists will place pillows, medicine balls or towels wrapped around the patient to assist in supporting the patient in the upright, sitting position. While this sometimes works, it can provide inconsistent results.

Accordingly, there remains room for improvement in the field of supporting immobilized, elderly, disabled and/or recovering patients who lack the strength to support themselves in an upright sitting position.

SUMMARY OF THE INVENTION

An apparatus and related method of supporting a patient in upright, sitting position during a treatment, for example during physical therapy, is provided.

In one embodiment, the apparatus can be a support device including a base frame, a support arm, a center bolster and a back support movably joined with the base frame and/or the center bolster so that the base frame and back support can support the center bolster in an upright position.

In a further embodiment, the support device can include one or more forward support arms that can be configured to secure to a support structure, such as a portion of a support bed and/or floor under the support bed. In turn, this connection to the support structure can anchor the support device to that structure, thereby preventing the support device from moving relative to and/or sliding across a surface of a support bed on which the patient is located.

In still a further embodiment, the forward support arms can include straps that can be extended to and wrapped around a support structure such as a portion of a support bed and/or floor under the support bed. The straps can include a reusable closure so that each strap can be manually attachable and detachable relative to the support structure.

In another embodiment, one or more lateral bolsters can be joined with the center bolster and/or base frame to laterally stabilize the patient. These lateral bolsters can be joined with the center bolster and/or base frame to enable the supports to be moved laterally inward toward a vertical axis of the center bolster and/or device. The lateral bolsters themselves can rotate about respective rods that are oriented generally vertically. Locking mechanisms may be provided to secure the lateral bolsters in preselected orientations relative to the center bolster and one another. Optionally, the lateral bolsters also can be adjustable vertically, up and down the center bolster, and/or adjustable in a fixed angular or other laterally inward and outward relation to a longitudinal axis of the support device.

In still another embodiment, the support device can be void of a seat bottom disposed under the patient. For example, the device can include a patient opening through which an upper surface of the support bed is readily accessible. The patient can be disposed and seated in the patient opening, directly on the upper surface of the support bed. In some cases, no major structural part of the support device is disposed under the patient when the patient is supported by the support device in the upright seated position.

In even another embodiment, a method of using the support device during a treatment, such as a physical therapy session, administration of medication, feeding or other similar activities, is provided. The method can include moving the back support of the support device from a stored mode in which the back support is adjacent the center bolster support, to a support mode in which the back support is moved away from the center bolster. Optionally, the back support can be moved so that it engages an upper surface of the support bed on which the patient is supported, and on which the support device is placed. The back support can be used to prevent the center bolster from tipping backward when the patient leans on it. The patient can be leaned against the center bolster in an upright, seated position on the support bed, generally within a portion of the support device. The support device can support the patient in the upright position. Optionally, at least one lateral bolster is placed adjacent the patient while the patient is in the upright position on the support bed, so as to engage one or both sides of the patient's torso if the patient starts leaning toward a side. In turn, the support device can prevent the patient from toppling to the side with the lateral bolster or rearward with the center bolster.

In yet another embodiment, the method can include selectively pivoting one or more lateral bolsters toward a vertical axis of the center bolster, and toward the patient while the patient is in the upright position. This can enable at least one lateral side bolster to be positioned to engage at least one of the left and/or right side of the patient's torso if the patient starts leaning toward a side. In turn, this can prevent the patient from toppling to the side.

In still yet a further embodiment, the method can include vertically adjusting the lateral bolsters up and down relative to the center bolster.

In yet even another embodiment, the method can include slidably moving the lateral bolsters toward or away from one another in front of the center bolster.

In a further embodiment, the method can include administering physical therapy to the patient while the patient is supported by the support device on the support bed.

In still a further embodiment, the method can include securing the support device to a support structure, such as part of the support bed, a floor under the support bed and/or some other structure. For example, the support device can include one or more forward support arms. The securing step can include extending an under bed extension, for example, a strap or a bar, from the forward support arm, and securing the under bed extension to a frame of the support bed under the patient to stabilize the support device with the center bolster being substantially vertical. As another example, the securing step can include extending a floor leg from the forward support arm to a floor mat to stabilize the support device with the center bolster being substantially vertical.

In still yet a further embodiment, the method can include moving a vertical support bar joined with the center bolster and/or back support to a locked position to effectively lock the back support in the support mode while the support device is supporting the patient in the upright, seated position.

In even a further embodiment, the vertical support bar can be associated with a locking mechanism having another bar and a pivot element. Opposite ends of opposing vertical support bars can be attached movably to the center bolster and back support. The vertical support bars can be parallel to one another when the back support is in the stored mode. Upon moving the back support to the support mode and away from the center bolster, the vertical support bars can take on a V-configuration, and then a generally linear configuration in the full support mode.

In yet even a further embodiment, the base frame can be in the form of one or more vertical supports joined with the center bolster. The vertical supports may or may not be joined to one another with an intermediate bar. The vertical supports can be joined with the back support, with the back support movable relative thereto from a stored mode to a support mode.

The current embodiments of the support device and related method of use provide benefits in healthcare, for example with regard to physical therapy, that previously have been unachievable. For example, the current embodiments can adequately and safely support a patient during therapy and other treatments, and can be used as a back support for patients transitioning into fully independent upright sitting. Further, with the current embodiments, healthcare providers, such as therapists, can avoid seeking additional staff members to support patients in upright sitting configurations. This can prevent the needless tying up of another staff member's time. This means that each staff member can be more efficient, leading to better care, more patients seen per day and lower payroll costs. In turn, this reduces the cost of the treatment and/or physical therapy for the facility and accordingly, may lower the cost for the patient and the insurance company. Using the current embodiments, healthcare providers also can avoid use of subpar and makeshift supports that might increase risk for the patient. Lastly, the current embodiments can generally provide therapists and healthcare providers with the ability to provide better care with more flexibility.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
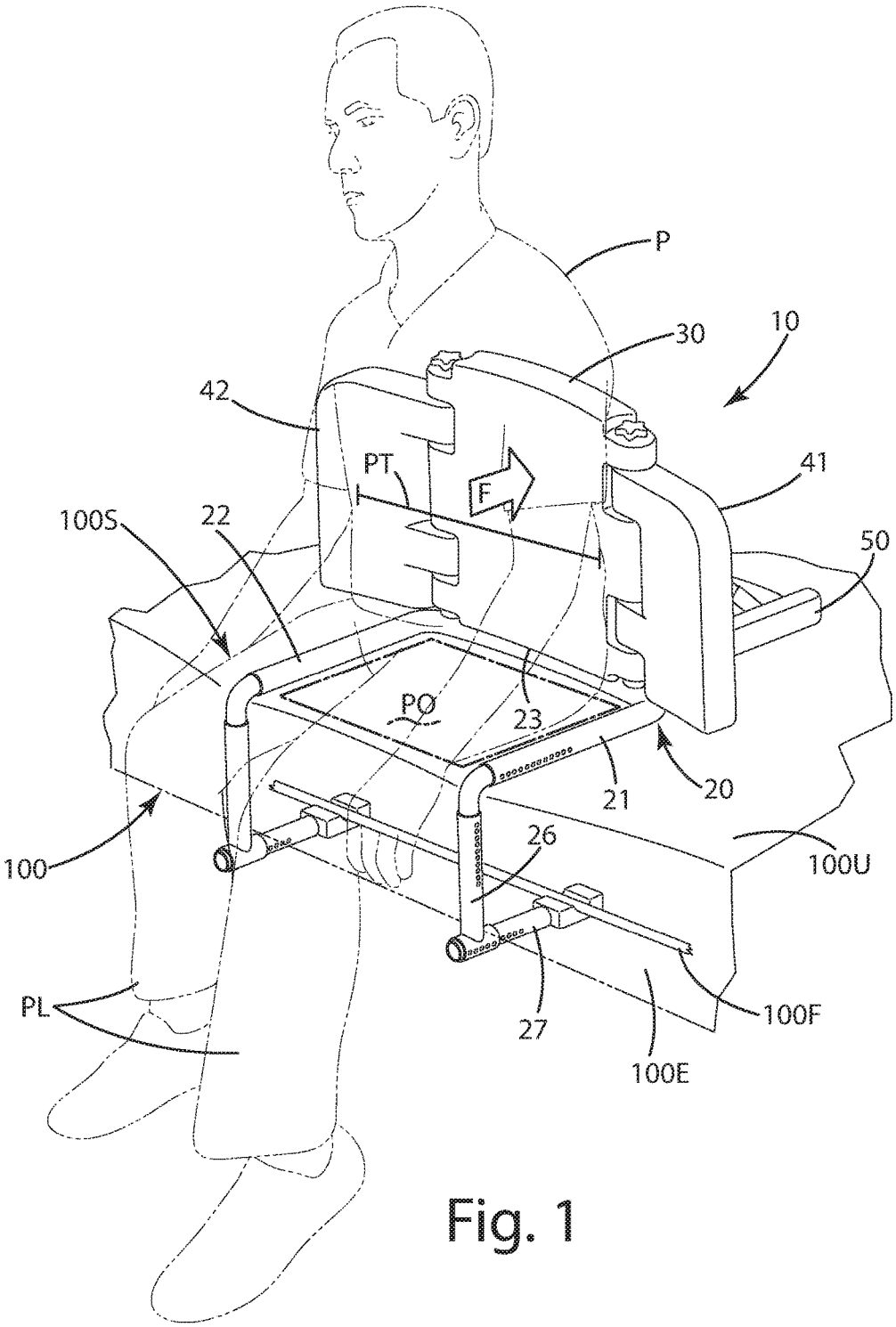
FIG. 1 is a front perspective view of the support device of a current embodiment disposed on a support bed and in a support position.
Figure 2:
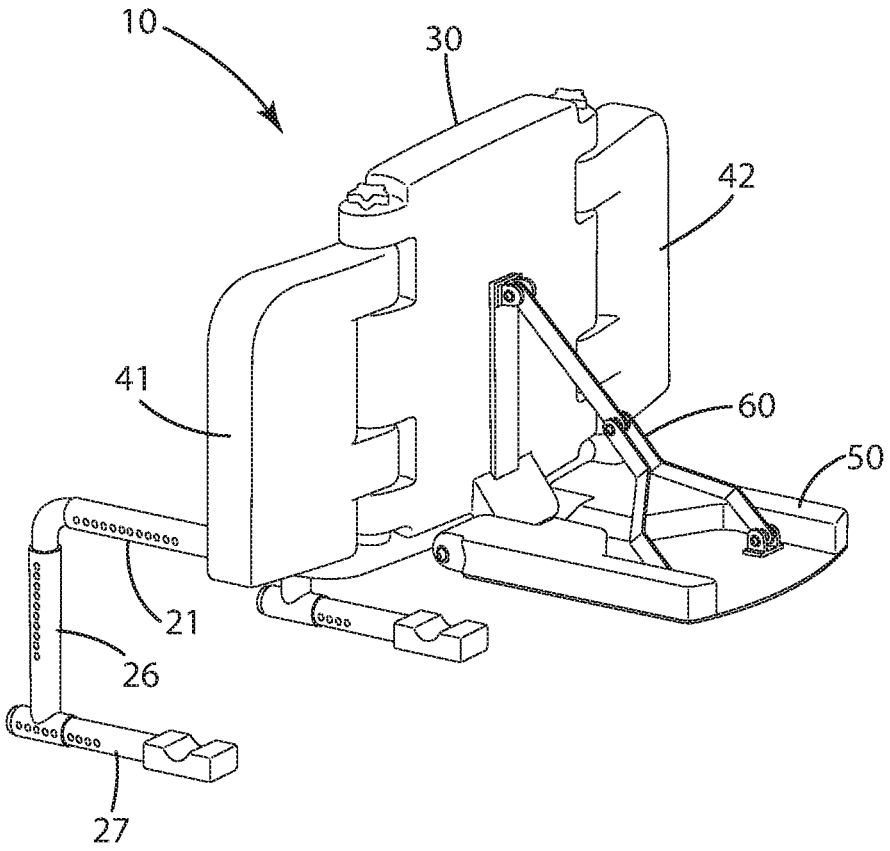
FIG. 2 is a rear perspective view of the support device disposed on a support bed and in a support position.

A current embodiment of the support device is illustrated in FIGS. 1-9, and generally designated 10. The support device 10 generally includes a base frame 20 that is joined with a center bolster 30, first and second lateral bolsters 41 and 42, and a back support 50. The center bolster 30 is configured to directly support an anterior portion or back of a patient as described in connection with the method further below. The back support 50 and base frame 20 can be configured to support the center bolster in an upright substantially vertical position on a support bed. The first and second lateral bolsters 41 and 42 can be joined with the center bolster and/or base frame. These lateral bolsters can move inward toward a vertical axis VA of the center bolster and/or the base frame. The lateral bolsters can be positionable against the sides of the patient's torso when seated adjacent the center bolster to provide lateral support to the patient and impair the patient from toppling over laterally, that is to one side or the other.

The support device and methods of the current embodiment are described here in use in a hospital, nursing home, or other healthcare facility setting. Of course, the embodiments are also well suited for use in home settings, with a family caregiver or visiting nurse utilizing the support device and method. Further, as described herein, the support device and method are associated with the administration of physical therapy. The physical therapy can be administered by a healthcare provider, such as a physical therapist, by a non-healthcare provider, or by the patient. In addition to physical therapy, the embodiments can also be utilized in conjunction with other treatments, such as the administration of medication, feeding, examination and/or diagnosis activities. In general, the term physical therapy can optionally include true physical therapy as well as the foregoing administration of medication, feeding, examination and/or diagnosis activities.

Further, as used herein, the term support bed can be used to describe a bed or other support surface that is configured to support patient in a lying down or supine position. Support beds include hospital beds, nursing facility beds, in-home beds, couches, therapy tables, gurneys, evacuation boards, and any other type of support surface adapted to support a patient in a generally supine position, with or without appendages of the patient dangling from the support device.

Figure 3:
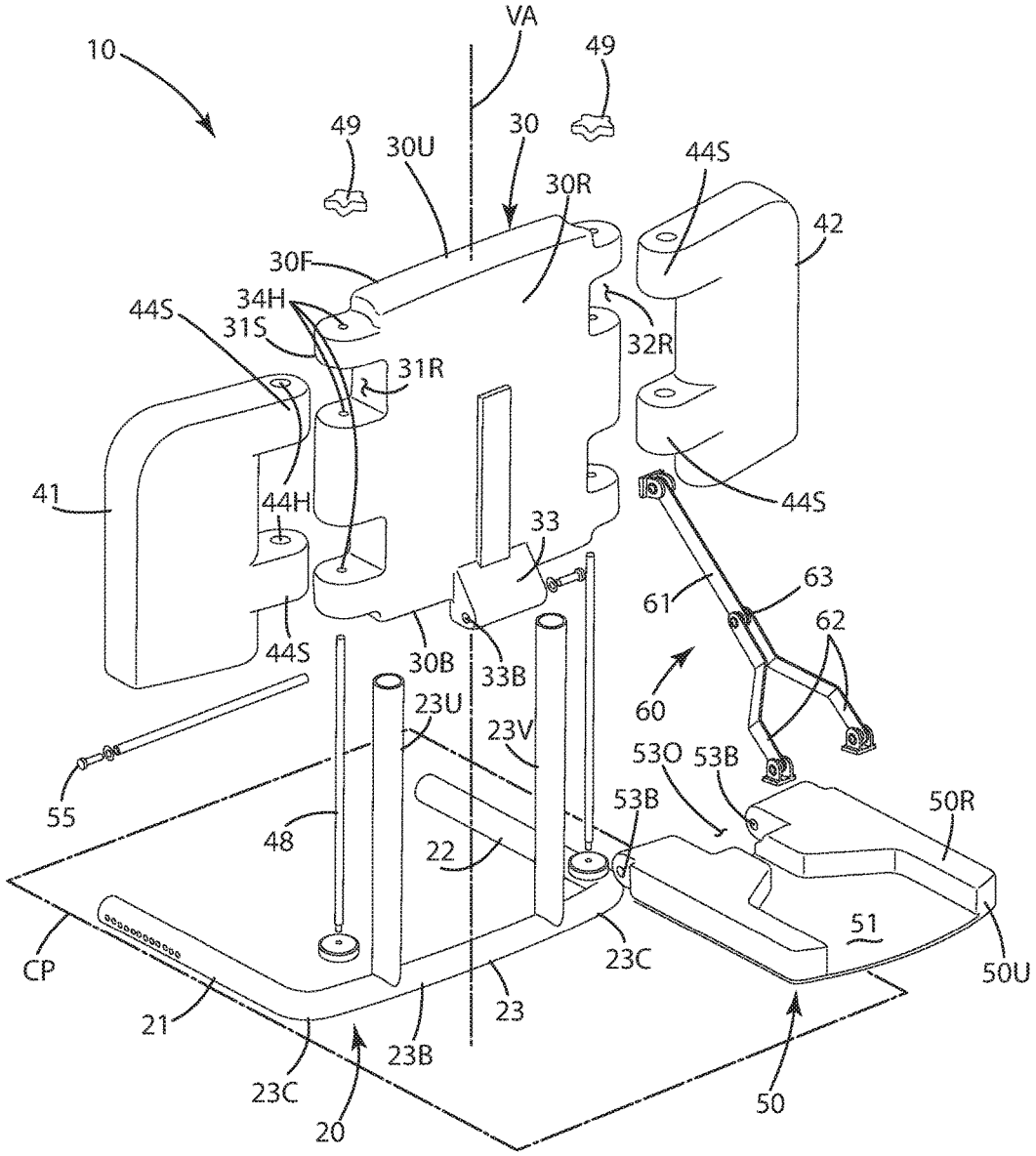
FIG. 3 is an exploded perspective view of the support device.
Figure 4:
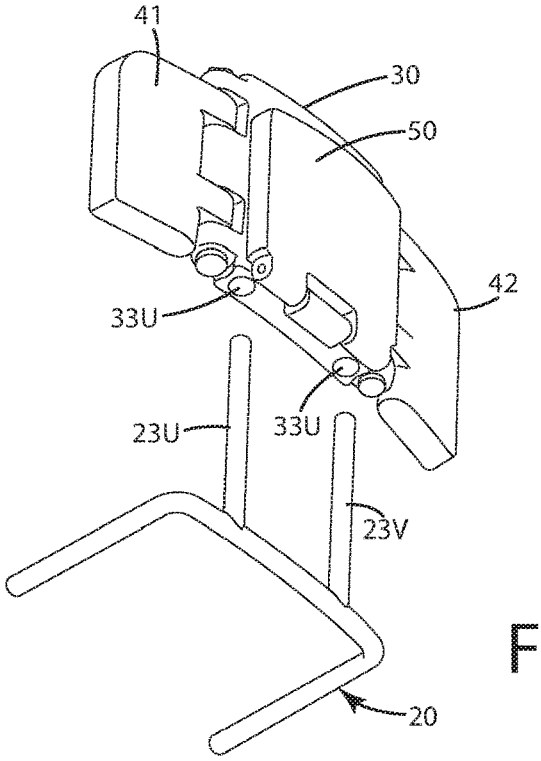
FIG. 4 is a bottom perspective view of a base frame being inserted into a center bolster of the support device upon assembly of the support device.

Turning now to the components of the support device 10, to begin the base frame 20 can be constructed as a rigid supportive structure. As illustrated in FIG. 3, the base frame 20 can include a center bolster support 23, which can include a substantially horizontal bar 23B as well as upstanding bars 23U and 23V. The upstanding bars 23U and 23V can be configured to interface or otherwise join with the center bolster 30. These bars can be of a generally vertical, upright configuration when the support device is in use on a substantially horizontal surface. As an example, the bars 23U and 23V can extend upwardly, generally parallel to a vertical axis VA of the base frame and/or center bolster. In some cases however these bars 23U and 23V can be offset relative to vertical axis VA when the base frame is placed on a horizontal surface. Optionally, the bars can be offset from the vertical axis by about 1° to about 45°, further optionally about 5° to 25°, and even further optionally about 10° to about 15°, depending on the application and therapy to be administered.

The base frame 20 optionally can include or can be joined with first 21 and second 22 forward support arms that extend forwardly from the center bolster support 23. Optionally, the center bolster support 23 and support arms 21 and 22 can be part of a unitary tube structure that is bent or curved forwardly at the corners 23C of the base frame 20. The first and second forward support arms can extend forwardly from the center bolster support 23 and/or the center bolster 30 generally a distance of optionally 1 inch to 24 inches, further optionally 4 inches to 18 inches, even further optionally 6 inches to 12 inches, depending on the application and the type of support bed with which the support device is used.

As illustrated, the components of the base frame 20 can be constructed from hollow tubular bars. This can provide weight savings to the device, which can be in the range of optionally 5 pounds to 20 pounds, further optionally 15 pounds, even further optionally 10 pound or less. The base frame bars can be constructed from a rigid durable and strong material, such as metal, composites and/or suitable polymers. Further, although shown as tubes, the bars of the base frame can be solid assuming that the material is light enough. Generally, the different components can be integral with one another and/or welded, screwed and/or otherwise fastened to one another.

As shown in FIG. 1, the base frame 20, and generally the support device 10, can be configured to define a patient opening PO. This patient opening PO can be sized so that a patient can sit with their behind seated directly on the support bed 100, and in particular on the upper surface 100U of the support bed. As used herein, the upper surface 100U of the support bed can include the actual physical upper surface of the support bed 100, as well as cases where the upper surface 100U is covered by blankets, bedding, pillows, or other items. Generally, the base frame and support device can be configured to include a patient opening so that, as described further below, the patient can be moved from a supine, lying down position to an upright, seated position on the side 100S of the bed 100. The support device can be installed around the patient in that upright seated position, without the therapist having to lift the patient again off the upper surface 100U of the support bed. This can reduce the amount of lifting the physical therapist performs on the patient.

As shown in FIG. 1, when the patient P is supported by the support device 10, the first and second 21 and 22 forward support arms project adjacent and generally parallel to a least a portion of the patient's legs PL. Indeed, in the seated position, the first and second forward support arms can be adjacent the patient's legs PL, projecting forwardly from the center bolster. Optionally, when the support device is in use, the first and second support arms 21 and 22 project within a common plane CP as shown in FIG. 3. This common plane can be perpendicular to vertical axis VA, with the vertical axis VA optionally projecting orthogonally from the common plane CP. As described further below, this common plane also can be aligned with one or more surfaces of the back support 50 when it is disposed in a support mode. In some cases, the back support lies substantially in that common plane CP with the first and second forward support arms. By substantially in the same plane, it is meant that the portion of the back support can be within, parallel to, or slightly offset at about 1° to about 10° from the common plane CP.

As shown in FIGS. 1-4, the support device 10 includes a center bolster 30. The center bolster 30 is joined with the base frame 20. Optionally, in some embodiments, these components can be integrally formed with one another and constructed from the same material. As shown however, the center bolster is outfitted to define bores 33U and 33V that are shaped and sized to receive the upright bars 23U and 23V. Generally, the upright bars can be slid into the center bolster, and in particular into the respective bores 33U and 33V. The insides of the bores can closely match the outer diameters of the bars to provide a generally tight fit.

Although not shown, the bars can be secured in the bores with a fastener, such as a set screw, latch or other mechanism.

The center bolster 30 can include a front surface 30F and a rear surface 30R disposed on opposite sides of one another. The front and rear surfaces can be generally parallel to one another and to the vertical axis VA. The front surface can be sized and shaped to comfortably receive an anterior of a patient. For example, when a patient leans with their back against the front surface 30F of the center bolster 30, that front surface 30F can be contoured to provide a comfortable backing for the patient. The front surface can be smooth, and without any unwanted ridges or points. The front surface can include a padding or other cushion to provide additional comfort to the patient.

The components of the support device can be constructed from a polymeric material. As an example, the center bolster, as well as the first and second lateral support bolsters 41 and 42, and the back support 50 can be constructed from plastic and/or wood. These components can be formed via roto-molding, blow molding, injection molding, pour molding, or any other technique. Due to their construction, the components can be easily cleaned and sterilized, with minimal surface textures and/or contours that impair sterilization and/or cleaning. The components also can be easily disassembled from one another and the base frame so a user can perform a thorough cleaning of and/or service or maintenance to the device.

Returning to FIG. 3, the center bolster 30 further includes an upper edge 30U, first and second side edges 31S and 32S and a bottom edge 30B. The bottom edge 30 be can include a pivot base 33 which can define the axle bore 33B in which an axle 55 is disposed. This axle can extend through the bore 33B, as well as the bores 53B defined by the back support 50, so as to pivotally connect the back support to the pivot base. Optionally the pivot base 33 can be configured to be received in the pivot base opening 53O of the back support 50 so as to facilitate alignment of the respective bores and axle, and to provide a sturdy pivot connection.

The side edges 31S and 32S of the center bolster 30 can define one or more recesses 31R and 32R. These recesses can be configured to receive one or more side bolster arms 44S projecting from the first and second lateral bolsters. The side bolster arms and respective recesses can be constructed so as to cleanly and neatly inner fit together, yet still provide relative movement between the side bolsters and the center bolster.

Figure 8:
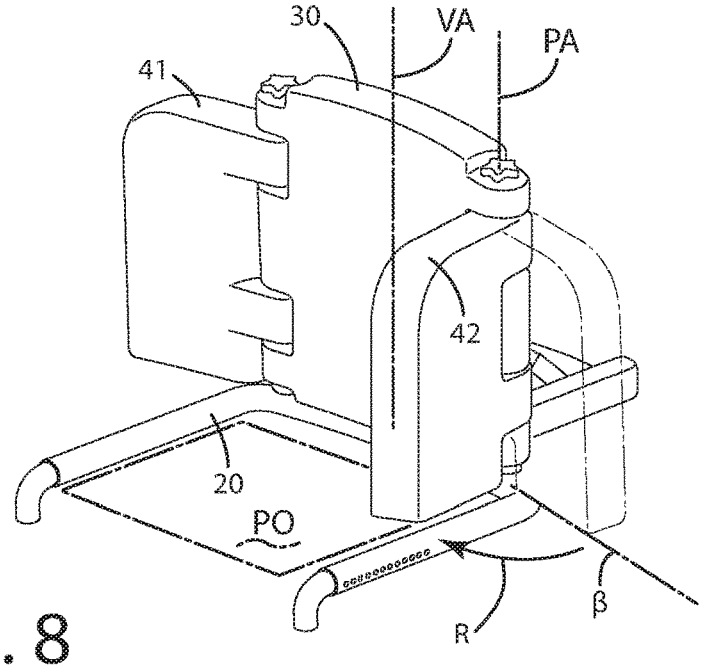
FIG. 8 is a front perspective view of the support device with a lateral bolster support being selectively adjusted to provide side support to a patient.
Figure 9:
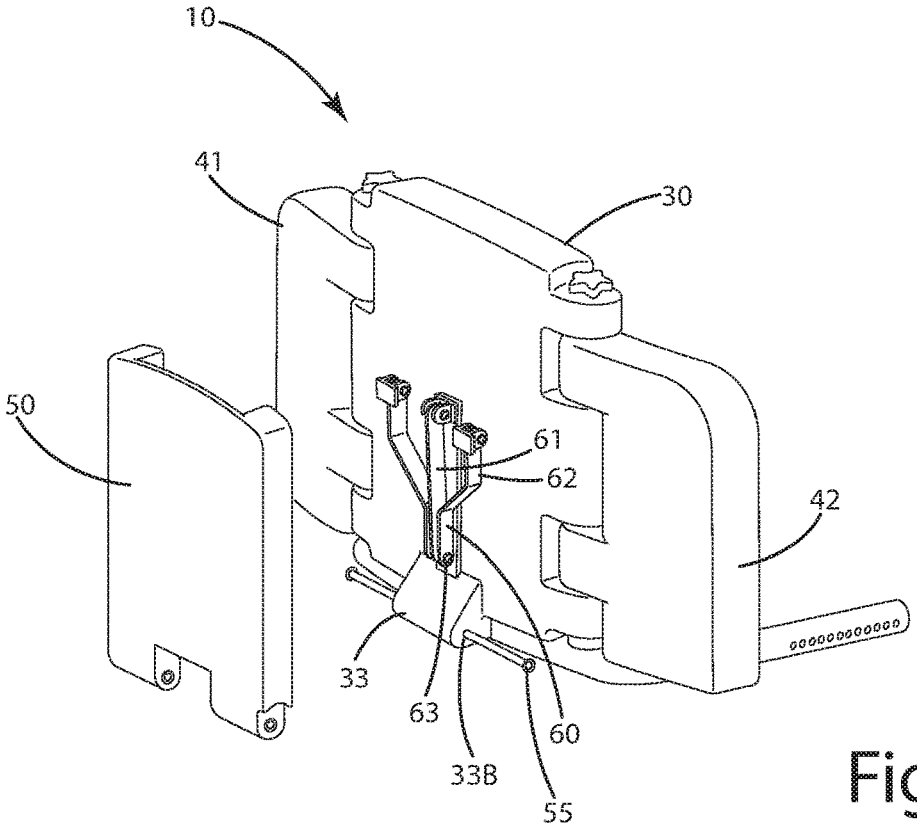
FIG. 9 is a rear perspective view of the support device with the back support removed.

As shown in FIGS. 1, 3 and 8, the first and second lateral bolsters 41 and 42 can be pivotally joined with the center bolster and can pivot inward and outward relative to the vertical axis VA, or generally toward and away from the front surface 30F of the center bolster 30. As described below, this can be helpful to provide side support to a patient supported by the device 10. The relative movement of the lateral bolsters can be a pivoting rotating movement. For example, as shown in FIG. 8, the lateral side bolster 42 can be rotated in direction R about a pivot axis PA. This pivot axis can be parallel to the vertical axis VA of the center bolster and support in general. Of course, in other embodiments, these axes can be offset some minor angle to one another yet still be substantially parallel to one another. In use, the lateral bolster can be pivoted inward in direction R, away from the base reference line B (FIG. 8) a predetermined angle depending on the size, shape and strength of the patient. In most cases, the lateral bolsters can be moved inward as far as possible until they engage the sides of the patient's torso PT as shown in FIG. 1. In turn, this can provide lateral support to the patient, impairing and/or preventing the patient from toppling to one side or the other.

To effect the pivoting, the center bolster again defines holes 34H that are aligned with holes 44H defined in the respective lateral side bolsters. A rod or bar 48 can be disposed coaxially through the respective holes 34H and 44H, thereby securing the lateral bolsters to the center bolster in a rotational relationship. This rod 48 can be substantially parallel to the pivot axis PA. The rod can be joined with a locknut 47 and an adjustment knob 49. The adjustment knob can be located near the upper edge 30U of the center bolster 30 so that it is easily accessible. After loosening the knob 49, a user can selectively move the lateral bolster in direction R as shown in FIG. 8. When a desired orientation of the lateral side bolster is achieved, a user can then tighten knob 49 which in turn clamps the arms 44S of the side bolsters within the recesses 31R, thereby locking and/or securing the lateral bolster in a fixed relative position and at a fixed angle relative to a baseline B. The baseline B can be a line generally perpendicular to the vertical axis and lying in a horizontal plane, optionally aligned with the center bar of the base frame 20. The mechanisms associated with the vertical rods 48 can be referred to as locks that selectively lock the first and second lateral side bolsters and respective angular positions relative to the vertical axis VA and/or the baseline B. Of course, other configurations and mechanisms can be used to movably and/or rotatably join the lateral side bolsters 41 and 42 with the center bolster 30.

As mentioned above, the support device 10 includes a back support 50 that is movably joined with the center bolster 30 and/or the base frame 20. The back support 50 is movable from a stored mode in which the back support is adjacent and substantially parallel to the center bolster 30 and optionally the rear surface 30 R of the center bolster, to a support mode. By substantially parallel to the center bolster, it is meant that the back support is optionally parallel to the center bolster and further optionally 1° to 8° offset relative to the center bolster. The back support also might not contact or touch the center bolster for it to be adjacent to it. In the support mode, the back support is moved away from the center bolster such that the back support is substantially in the common plane CP, and/or generally parallel to an upper surface 100U of the support bed 100.

The back support 50 can include an upper edge 50U and a lower edge 50B. The rear surface 50R of the back support 50 can generally face the rear surface 30R of the center bolster. The rear surface 50R of the back support can define a connector recess 51. The connector recess 51 can be sized and shaped to support a connector element 60. This connector element can be constructed as a linkage. The connector element/linkage 60 can be adapted to selectively lock the back support in center bolster fixed angular relationship relative to one another. For example the linkage 60 can be configured to lock the back support 50 so that it lays in the common plane CP in the support mode. Optionally in this mode, the back support can be perpendicular to the vertical axis VA and/or the center bolster 30. The linkage 60 also can be configured to allow the back support 50 to fold up and be generally parallel to the center bolster 30 and/or vertical axis or base frame.

Figure 7:
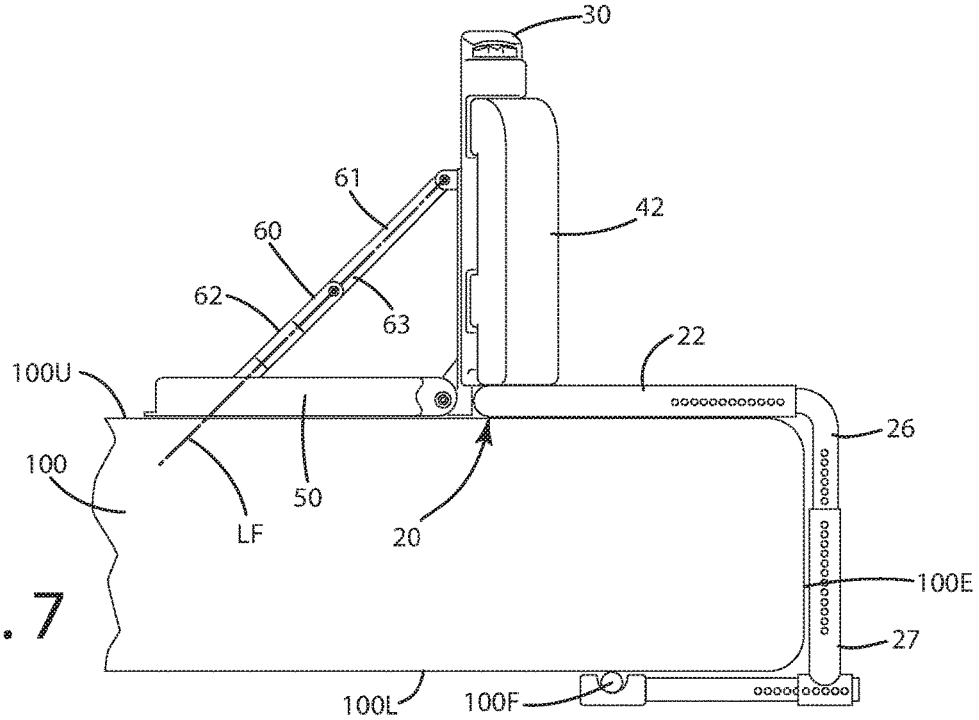
FIG. 7 is a side view of the support device with the back support in a support mode.

The linkage 60 can include a first rigid bar 61 and one or more second rigid bars 62. These rigid bars pivot relative to one another about a pivot element 63, which can be in the form of a pin. The first rigid bar 61 can be pivotally or rotatably joined with the center bolster 30. The second rigid bar 62 can be pivotally joined with the back support 50. As shown in FIG. 7, in the support mode, the first 61 and second 62 bars can be aligned in parallel with one another along a linear reference line LF, and can extend in opposite directions from the pivot element 63. In the stored mode shown in FIG. 9, these rigid bars 61 and 62 can be adjacent one another and can extend in the same direction from the pivot element 63.

Optionally, when transitioning the back support 50 from the stored mode to the support mode, the linkage can be constructed so that the first and second bars 61 and 62 start out in the stored mode, adjacent one another and extending in the same direction from the pivot element 63. As the back support 50 is pivoted rotated or otherwise moved away from the center bolster, the rigid bars and pivot element collectively form and expanding V shape. When the back support achieves its full support mode, the bars 61 and 62 can be aligned on the reference line LF. In general, when in the support mode, the back support can be moved away from the center bolster some angle of optionally 45° to 110°, further optionally 60° to 95°, even further optionally 90° offset from the center bolster 30 and/or vertical axis VA.

Further optionally, although illustrated as a linkage, the connector element 60 can be replaced with a single bar that swings outward at a first end from the center bolster. A second opposite end of the bar can be positioned in a recess in the back support to secure that bar in a fixed position and thereby secure the back support in the support mode. Other mechanisms and structures are contemplated to support the back support. Optionally, however all of these mechanisms can allow movement of the back support 50 relative to the center bolster 30.

As shown in FIG. 1, the support device 10 includes the first and second forward support arms 21 in 22. Again these forward support arms can be placed adjacent the generally rest on the upper surface 100U of the support bed 100. The support arms can include second portions 26 and 27 that are attached to the portion of the support arms adjacent the upper surface 100U. Optionally, the second portion 26 and extend downward beside a lateral edge 100E of the support bed 100. The second portion 27 can extend rearward under the underside or lower surface 100L of the support bed 100. The second portion 27 can be parallel to a portion of the forward support arm 21 that is above the upper surface 100U. The second portion 27 can extend perpendicular to the portion 26. Of course, in some cases, it can be disposed at other angles depending on the application. Ultimately, the second portion 27 can extend to a portion of the support bed frame 100F which is disposed under the upper surface 100U of the support bed 100. The second portion 27 can include a strap, fastener, clamped, cam, magnet or other element that can secure the second portion 27 fixedly relative to the bed frame 100F. In some cases, a magnet can assist in placing the portion 27 adjacent the bed frame. With the fixed attachment of the forward support arms to the bed frame 100F, the support device, and more particularly the center bolster 30 becomes substantially non-slidable and/or immovable relative to the support bed, and in particular the support bed upper surface. Of course, other mechanisms can be provided to prevent movement of the support device relative to the upper surface 100U of the support bed 100.

Figure 10:
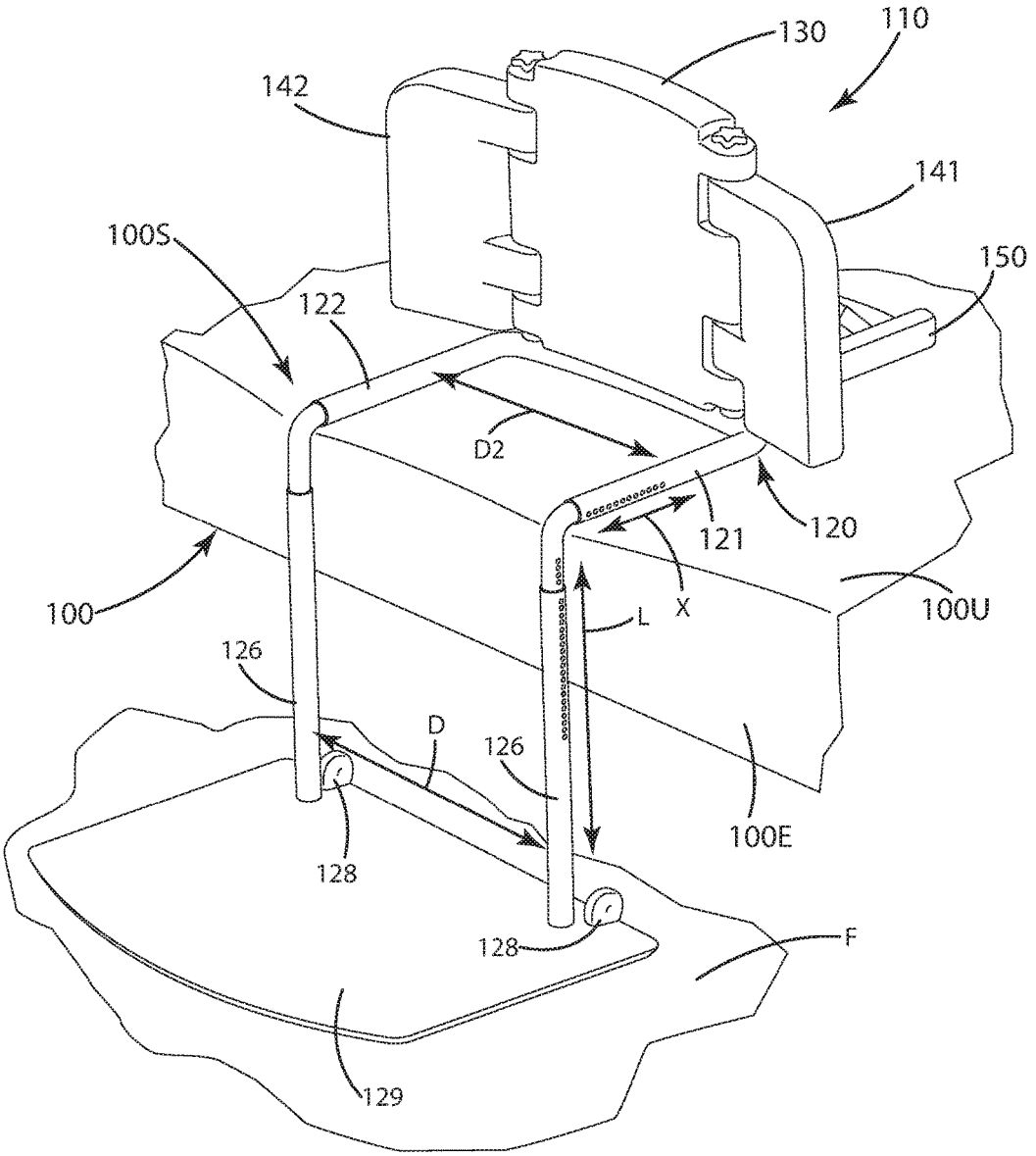
FIG. 10 is a front perspective view of a first alternative embodiment of the support device including a floor mat support.
Figure 11:
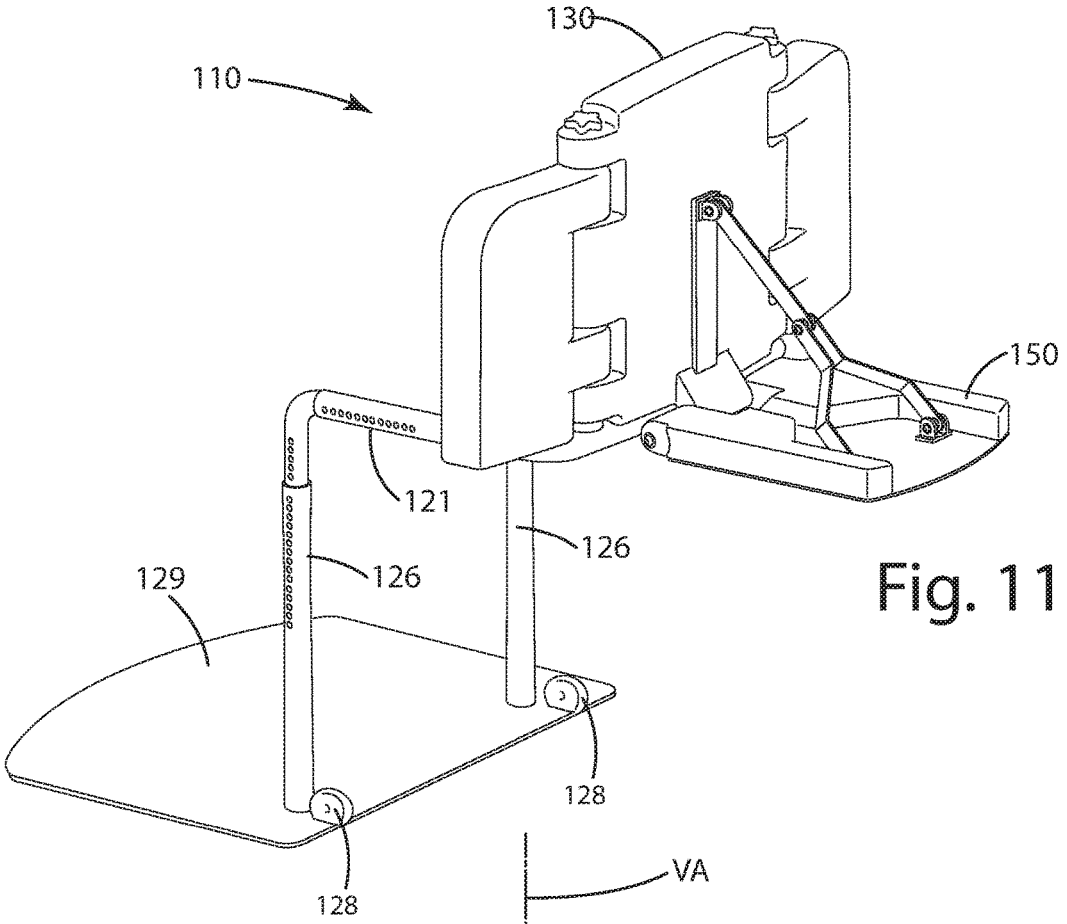
FIG. 11 is a rear perspective view of the first alternative embodiment of the support device.
Figure 12:
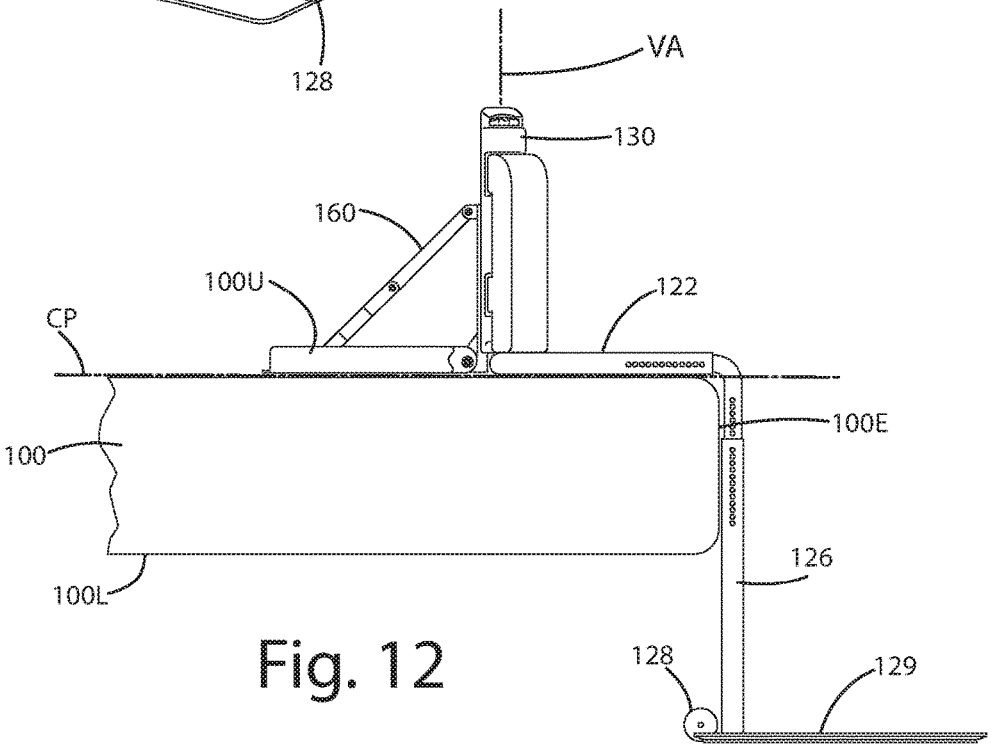
FIG. 12 is a side view of the first alternative embodiment of the support device supporting a patient in an upright sitting position on a support bed.

For example, as shown in the first alternative embodiment of FIGS. 10-12, the support device 110 can be outfitted with first and second forward support arms 121 and 122. Instead of extending forwardly and then to the underside 100L of the support bed 100, these support arms can include second portions 126, optionally in the form of floor legs, that extend downward to a base 129 to stabilize the support device with the center bolster being substantially vertical. The base 129 can be in the form of a floor mat, optionally having micro suction elements on its lower surface to secure the floor mat to the floor F, without having to rely on the weight of the therapist and/or patient to secure the support device. Of course, the floor mat optionally can be sized and dimensioned to allow the patient to partially stand thereon or otherwise place their feet thereon. It also can be sized and shaped to allow the physical therapist to stand thereon. The second portions 126 can be spaced a distance D from one another at the floor mat 129. This distance D can be equal to the distance D2 separating the first and second forward support arms 121 and 122. Optionally, the second portions 126 can be adjustable so as to vary the length L thereof in the Y direction as shown in FIG. 10. This can enable the portions to accommodate a variety of supports at different heights from the floor F. Further optionally, the first and second forward support arms 121 and 122 can be adjustable in length in the X direction to accommodate different upright sitting positions of a patient. The mechanisms for performing these adjustments can be clamps, set screws, detents, removable pins, and the like.

Optionally, the floor mat 129 and/or the portions 126 can include one or more wheels 128. These wheels can enable the support device with the floor mat to be easily moved about a facility. In effect, the wheels can enable the support device to be transported similar to a dolly. If desired, the center bolster and/or support device can include one or more grab handles to allow the support device to be tilted rearward (after removal from the support bed 100) and wheeled to another location.

Further optionally, although not shown, the support device can include clips or other types of tube organizers to support tubes that may be associated with the patient. The support device can include seatbelts that extend from the center bolster and/or base frame, around the patient's waist, and back to the center bolster and/or base frame, particularly for home use support devices. If desired, the center bolster can be configured so that it swings about an axis to the left or right so that the patient can lay down rearward on the support bed in certain cases.

A method of using support device 10 of the current embodiment will now be described in further detail. As mentioned above, the method can be implemented in conjunction with administering physical therapy to a patient P. In many cases, the patient P will lack the core strength to hold themselves in an upright seated position during the physical therapy. Further, the patient initially can be disposed in a lying down or supine position in which they are lying flat on their back on the support bed 100.

Figure 5:
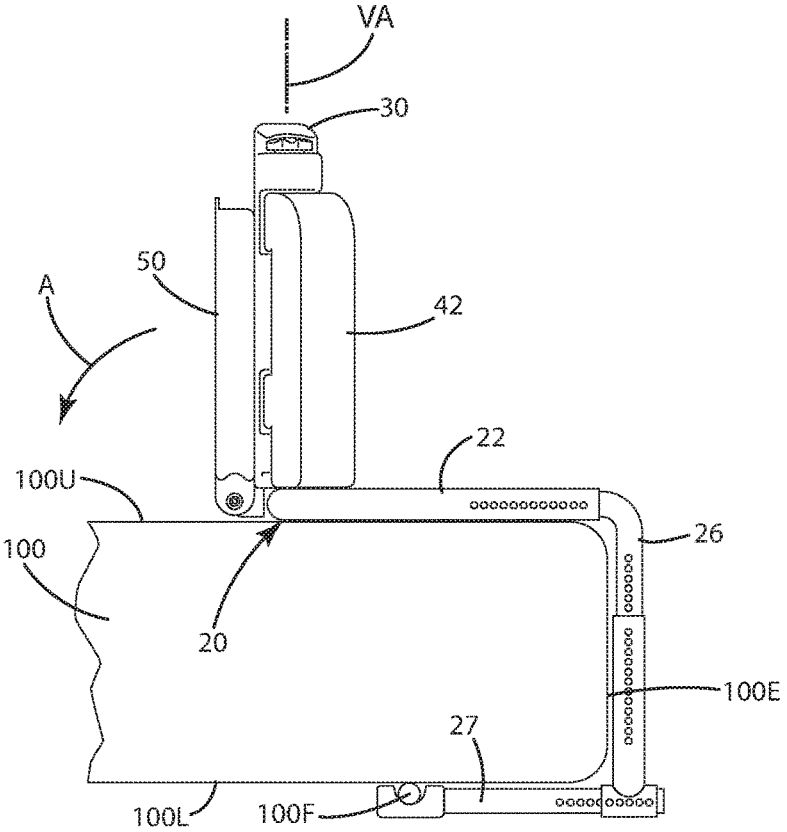
FIG. 5 is a side view of the support device with a back support in a stored mode.
Figure 6:
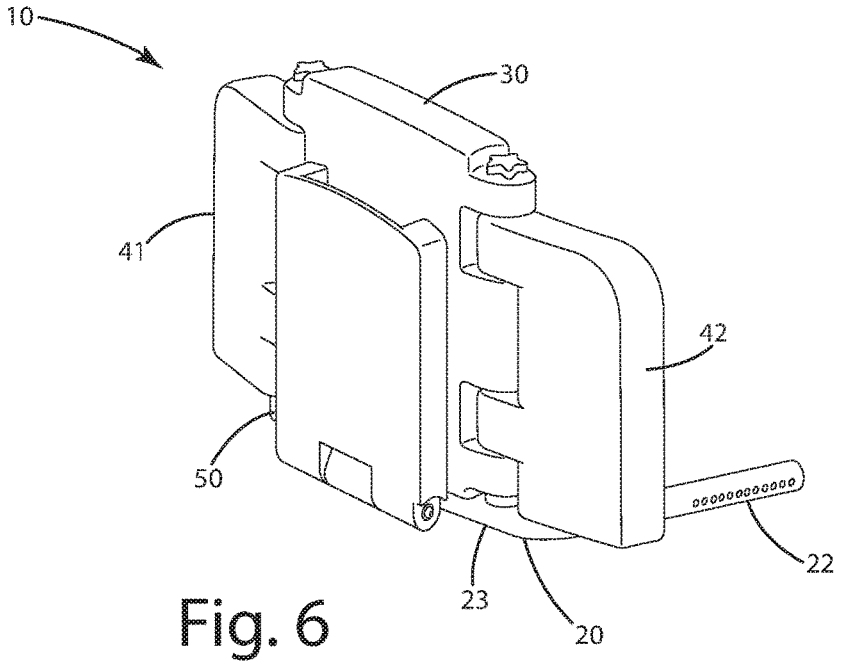
FIG. 6 is a rear perspective view of the support device with the back support in the stored mode.

Accordingly, the physical therapist can bring the support device 10 to the patient while the patient is on the support bed 100. The therapist can inform the patient of the physical therapy session. The therapist can place the support device on the support bed 100. In particular, as shown in FIGS. 1 and 5, the therapist can place the support device on the upper surface 100U of the support bed 100. The first and second forward support arms 21 and 22 can generally engage the upper surface 100U. The therapist can extend the portions 26 over the lateral edge 100E of the support bed 100. All of this can be performed while the patient remains on the support bed, in the supine position and/or an upright seated position in the patient opening PO. The therapist can connect the portion 27 to the under bed frame 100F in a fixed manner generally locking the portion and the base frame 22 the frame 100F. In this configuration, the forward support arms 21 and 22 can rest on the upper surface 100U. The vertical axis VA and center bolster 30 can be perpendicular and/or orthogonal to the upper surface 100U of the support bed 100.

The therapist can move the back support 50 away from the center bolster 30 in the direction A shown in FIG. 5. In so doing, the back support pivots about the pivot axle 55. The connector element 60 also begins to extend so that the bars 61 and 62 take on a generally V-shape as the back support is moved in direction A, out of the stored mode into the support mode. This support mode is further illustrated in FIGS. 1, 2 and 7. There, as described above, the back support 50 lies substantially in a same or common plane CP as the first and second forward support arms 21 and 22, adjacent the upper surface 100 U of the support bed 100. The first and second bar 61 and 62 are also locked securely in the position shown in FIG. 7 so that the back support 50 is at a fixed angular relationship position relative to the center bolster 30.

Optionally, the support device 10 can be set up while the patient is laying any supine position on the support bed, or while the patient is seated and held upright by the therapist or another worker, with the patient's legs dangling over the side 100S of the support bed 100. In the latter situation, the patient P can sit within the patient opening PO of the base frame 20 as the therapist engages and sets up the back support 50 and connects the base frame 20 to the bed frame 100F or some other support structure. After the support device is set up so that it will not move or slide relative to the upper surface 100U of the bed 100, it is generally disposed behind an anterior of the patient P. The patient, using their own strength, and/or the therapist, can lean the patient P against the center bolster 30. In so doing, the patient and their weight transfers a force F to the center bolster 30. This force is transferred through the center bolster 30, to the base frame 20 and ultimately to the back support 50 against the upper surface of the support bed. In this manner, the support device supports the patient in the upright, seated position without the support device substantially sliding or moving across the upper surface 100U of the support bed 100. Optionally, in addition, the attachment of the forward support arms 21 and 22 effectively to the bed frame 100F assists in preventing the sliding and/or movement of the support device across the upper surface 100 of the support bed.

To provide further lateral support to the patient P, thereby preventing the patient from laterally toppling, the first and second lateral side bolsters 41 and 42 can be engaged. The therapist can selectively pivot those first and second lateral bolsters toward the vertical axis VA and generally toward the front surface 30F of the bolster 30. During this pivoting or movement of the lateral bolsters, the patient can be seated in an upright, sitting position within the patient opening PO of the support device 10. The first and second lateral side bolsters 41 and 42 can be positioned to engage the left side and/or right side of the patient's torso PT. The therapist can then utilize the locking mechanism, for example, by turning the knob 49 to fix the lateral side bolsters 41 and 42 in a fixed angular relation relative to the baseline B. Of course, depending on the patient's size and condition, the lateral side bolsters can be moved varying amounts. Again, with the lateral side bolsters in place, and the center bolster behind the patient, the patient can be substantially supported in upright sitting position. In this manner, the patient is basically self-supported (via the support device), without the need for a second therapist or worker to hold the patient P upright as the therapist administers physical therapy to the patient. From there, the therapist can administer the physical therapy.

The method of using the support device 110 of the first alternative embodiment shown in FIGS. 10-12 will now be described. This method is similar to the method immediately above with several exceptions. For example, the forward support arms in the embodiment shown in FIGS. 10-12 are attached to second portions or floor legs 126. These floor legs optionally can be already attached to the forward support arms 121 and 122, or they can be attached by the therapist upon arriving at the support bed. The therapist can adjust the overall length L of the respective floor legs so that the base frame 120 solidly rests on the upper surface 100U of the support bed 100, while the floor mat 129 rests firmly on the floor F. This adjustment can be made manually, via a system of detents or pins that engage the floor legs and/or the forward support arms to selectively set the length L. The other components of the support device 110, such as the back support 150 and the lateral side support bolsters 141 and 142 can be set up by the therapist in a manner similar to that described in the embodiment above.

During administration of the physical therapy, the therapist and/or the patient P can stand on or placed their feet on the floor mat 129. In turn, this can prevent the support device from sliding backward away from the side 100S of the bed, over the upper surface 100U of the bed. With the force applied to the floor mat 129, the bolster 130 is also maintained in a substantially vertical configuration as shown in FIG. 10, even when a patient is leaning on the center bolster and/or the lateral side bolsters. Optionally, where the floor mat includes suction elements to secure the floor mat in a fixed position relative to the floor, the therapist need not stand on the floor mat to stabilize the patient.

Further optionally, after the therapist has completed a session with a patient, the back support 150 can be folded up to its stored mode, against the center bolster. The support device can be slid off the upper surface 100U. The therapist can then tilt the support device and respective floor legs backwards so that the floor mat and support device are supported and wholly disposed on the wheels 128. This configuration, the support device can be wheeled away to another therapy location.

A fourth alternative embodiment of the support device is illustrated in FIGS. 13-16 and generally designated 210. This embodiment is similar to the embodiments above in structure, function and operation, with several exceptions. For example, the device 210 can include a rigid, supportive base frame 220 that includes first and second vertical supports 220V1 and 220V2. These vertical supports can be in the form of elongated tubes, bars, solid rods or other elements. The vertical supports can extend generally upwardly, parallel to a vertical axis VA of the device 210, base frame 220 and/or center bolster 230. In some cases, the vertical supports, however, can be offset relative to vertical axis VA when the base frame is placed on a horizontal surface. Optionally, one or both of the vertical supports can be offset from the vertical axis VA by optionally about 1° to about 45°, further optionally about 5° to about 25°, and even further optionally about 10° to about 15°, depending on the application and therapy to be administered. Further, it is to be understood that while two vertical supports are shown, more or less vertical supports can comprise the base frame 220.

The base frame 220, and in particular the vertical supports 220V1 and 220V2, can be attached optionally via fasteners 220F to the center bolster 230. The fasteners can be aligned along the lengths of the respective vertical supports. Optionally, the fasteners can be in the form of screws, rivets or bolts. In other constructions, the fasteners can be welded portions and/or cemented portions of the vertical supports joined with the center bolster. In some cases, the center bolster 230 and base frame 220 can be integrally formed with one another, and constructed from the same material.

The center bolster 230 can be constructed similar to the center bolster of the embodiments described above. Optionally, the center bolster 230 and its components can be constructed from metal, composites, polymeric or wood. The center bolster 230 can include a backer 230B. This backer 230B can be lightweight, yet rigid enough to support the weights of a wide range of patients. The center bolster 230 can include an engagement element 220C that is joined with the backer 230B. This engagement element 220C can be in the form of a cushion and/or padding covered with a water-repellant, nonadsorbing cover. It is this engagement element 220C against which a patient can be placed, and can lean against. This engagement element can be constructed from easily cleaned and sterilized material, and can be covered with a water-repellant, nonadsorbing cover as described in the embodiments above. The respective surfaces of the center bolster can be sized and shaped to comfortably receive an posterior of the patient, leaning with her back against the engagement element 220C.

Figure 14:
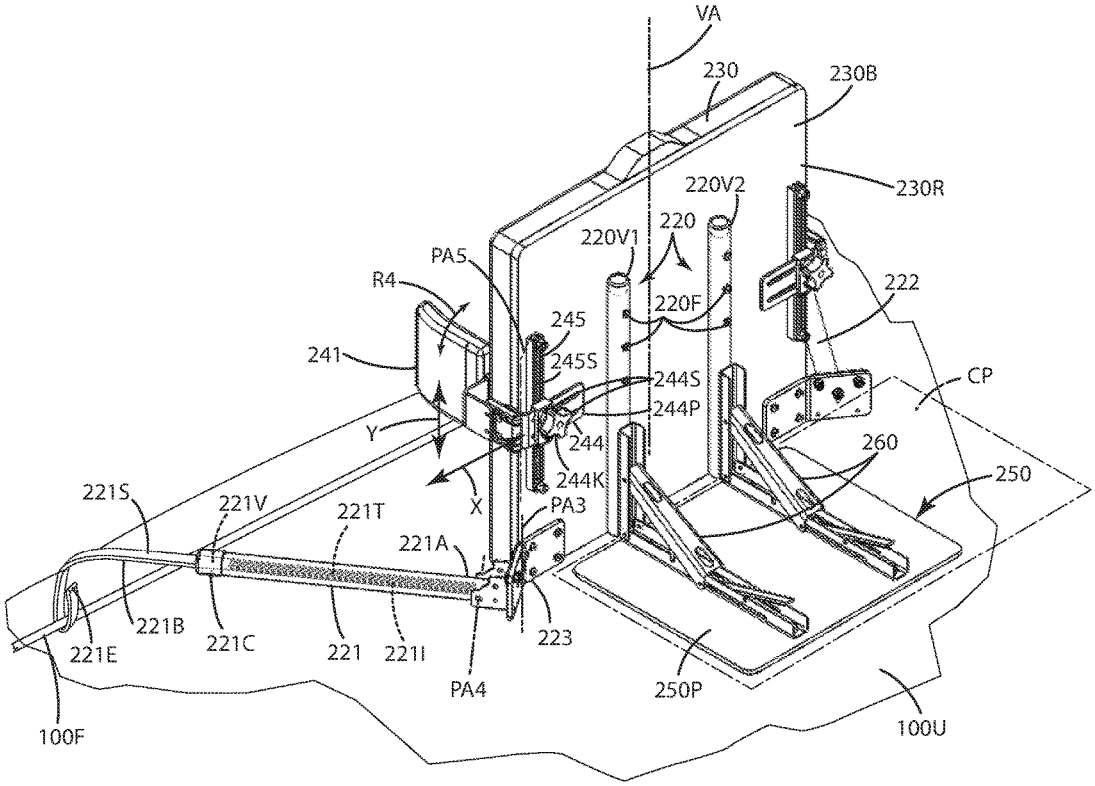
FIG. 14 is a rear perspective view of the support device disposed on a support bed and in a support position.
Figure 15:
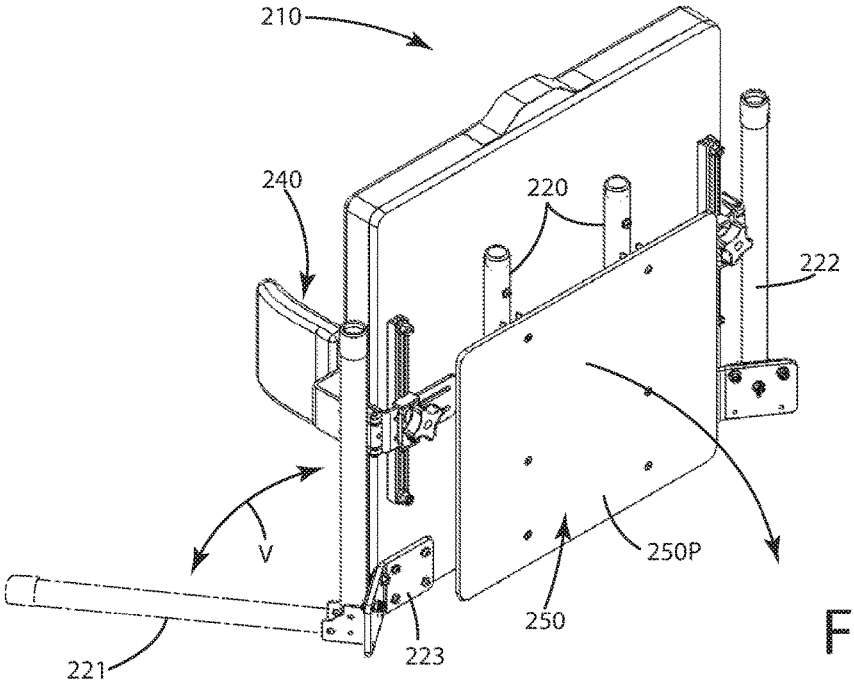
FIG. 15 is a rear perspective view of the support device with the back support in the stored mode.
Figure 16:
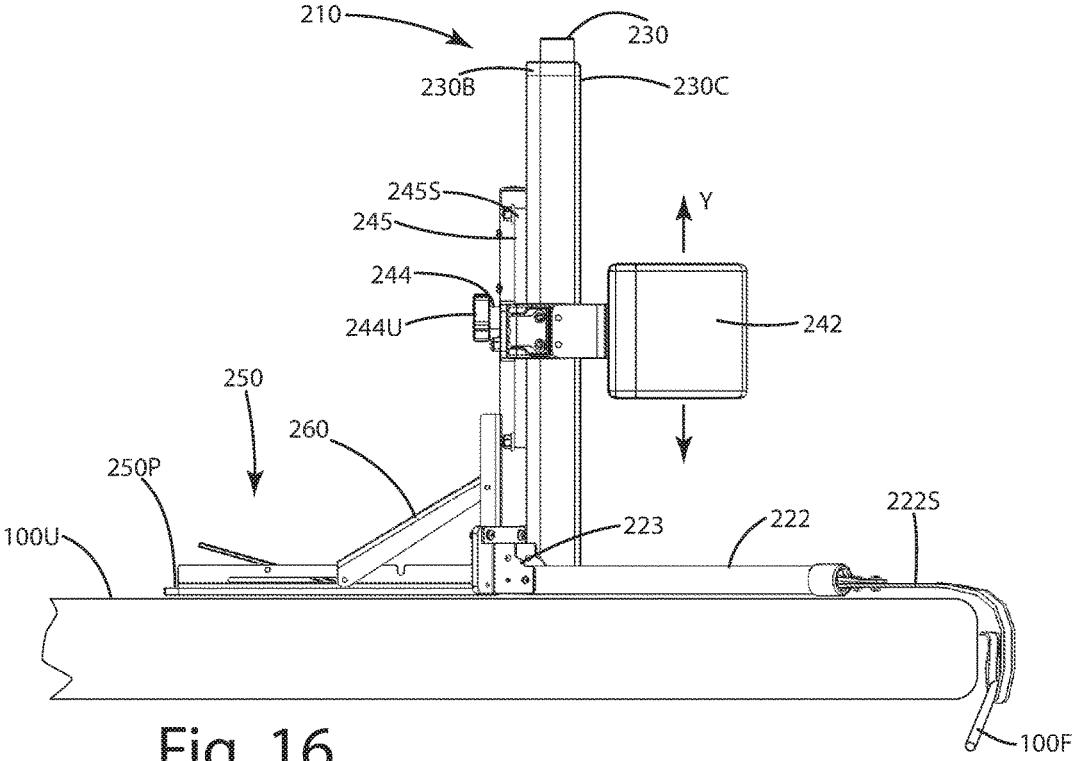
FIG. 16 is a side view of the support device with the back support in a support mode.

The support device 210 can include a back support 250 that is movably joined with the center bolster 230 and/or the base frame 220. As illustrated in FIG. 14, the back support 250 includes a back support plate 250P that is joined with foldable locking hinges 260 which are themselves joined with the base frame 220 and/or the center bolster 230. The back support 250 is operable in a stored mode, shown in FIG. 15 in which the back support 250, and optionally the plate 250P, is adjacent and substantially parallel to the center bolster 230 and/or vertical supports of the base frame 220, and optionally the rear surface 230R of the center bolster. The back support is reconfigurable from the stored mode to a support mode, as illustrated in FIG. 14. To attain the support mode, the back support is moved away from the center bolster 230 and the base frame 220 to the configuration shown in FIG. 14. There, the back support 250, and optionally the plate 250P, is substantially in the common plane CP and/or generally parallel to an upper surface 100U of the support bed 100.

While the illustrated back support 250 includes a foldable 90° locking hinge 260 to secure the support in the stored mode or in the support mode, other types of hinges or mechanisms can be substituted for this construction to secure the back support in a suitable orientation relative to a patient. Further optionally, in some cases, the back support can simply be fixedly attached to the center bolster or back in either an upright stored mode or a support mode, for example, with clamps or by fitting in fixed slots (not shown).

As mentioned above, the device 210 can include first and second forward support arms 221 and 222. These forward support arms can be similar to those of the embodiment above. For example, they can extend generally forwardly from the center bolster 230, and optionally forwardly away from a front surface 230F of the center bolster. The support arms can be constructed similarly, so only the first arm 221 will be described here, with the understanding that the second arm 222 can include the same components and operation. The forward support arm 221 can include an elongated bar or tube 221T. This tube 221T can be joined at a first end 221A to a hinge 223. This hinge can be fastened, joined or otherwise secured to the center bolster 230, optionally on the rear surface 230R thereof, and further optionally to the backer 230B. This joining can be achieved via fasteners, cement, welding or other similar constructions. The hinge can enable the support arm 221 to pivot about a pivot axis PA3, generally toward and away from the vertical axis VA along an arcuate path. The forward support arm 221 can be set at a predetermined angle D (FIG. 13) relative to the front surface 230F of the center bolster, optionally via attachment of the straps 221S to the bed, or some type of angular locking mechanism in the hinge 223. This predetermined angle can be optionally about 90° to about 150°, further optionally about 100° to about 140°. This angle also can be angled relative to a portion of the patient's legs when a patient is leaned against the device 210. In this example, the forward support arm 221 can extend an angle of about 10° to about 45°, further optionally about 35° relative to the direction in which the patient's legs extend. Generally, the forward support arm 221 can be moved to some angle that is wide enough to enable the patient to be seated against the device and yet narrow enough to provide some type of forward support and connect the arms to a support structure.

Optionally, the forward support arm 221 can be pivotally joined at its end 221A to the hinge 223 via a pin, fastener or other mechanism. With this connection, the arm 221 can pivot about the pivot axis PA4 from the forwardly extending position, shown in FIG. 14 to a vertical storage position shown in FIG. 15, moving generally in direction V. This can enable the arms to be satisfactorily stored when not in used and easily deployed when in use. Optionally, a locking mechanism can lock the forward support arm 221 in the stored and/or forwardly extending positions.

Similar to the embodiments described above, the forward support arm 221 can be constructed to be secured to a frame 100F of the support bed 100 under the patient to stabilize the support device, with the center bolster being substantially vertical. In this embodiment, however, the forward support 221 can include a first underbed extension 221S that is in the form of a strap. The strap 221S can extend from the second end 221C of the tube 220T. The strap 221S can be in the form of a web, cord, rope, cable, zip tie, wire, belt or other flexible elongate member. The strap 221S can be of a length sufficient to extend to and wrap at least partially around a portion of the bed frame 100F. As shown in FIG. 14, the strap 221S includes an end 221E and a main body 221B. The end and main body can include respective hook-and-loop fasteners so that the end 221E can be wrapped around a portion of the frame 100F, overlapped with and in contact with the main body 221B, thereby securing the strap to the frame. Of course, the hook-and-loop fasteners associated with the end and the body can be substituted with buttons, buckles, clasps, cams, ratcheting systems and the like.

Optionally, the under bed extension 221S, when in the form of a strap, can be retractably mounted to the forward support arm 221. For example, the arm 221 can include an internal spring 221I that is attached at one end 221A of the tube 221T in a fixed manner. The other end of the internal spring 221I can be attached to another end 221V of the strap 221S. The internal spring 221 can retract the strap 221S into the tube 221T when the strap is not connected to the bed frame, is not being pulled on by a user or otherwise not in use. When the user desires to utilize the strap, the user may grasp the end 221E or main body 221B, which can extend even in the stored mode or retracted mode from the tube. The user then can pull the strap out from the tube 221T. During this pulling of the strap by the user, the user overcomes the spring force of the internal spring 221I. Of course, this retractable strap feature can be absent, with the strap end 221V simply attached to the tube.

As shown in FIG. 14, the device 210 can include first and second lateral bolsters 241 and 242. These lateral bolsters can be movable in arcuate paths about a pivot axis PAS. This can enable the bolsters to pivot inward and outward relative to the vertical axis VA, along an arcuate path toward and away from the front surface 230F of the center bolster 30. As with the embodiment above, this can be helpful to provide side support to a patient supported by the device 210. The lateral bolsters can be pivotally joined with the center bolster and/or base frame via 90° locking hinges in some applications. This can enable the lateral bolsters to lock in the positions shown in FIG. 13 upon being deployed.

Figure 13:
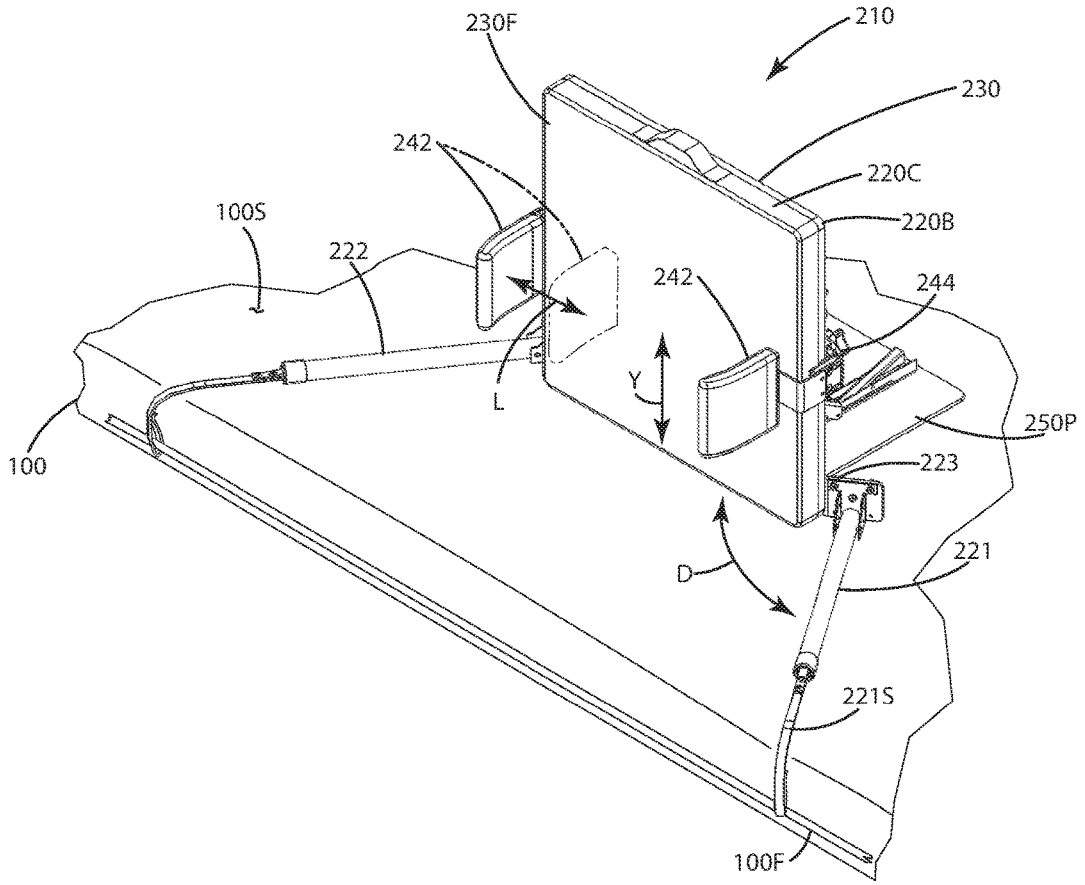
FIG. 13 is a front perspective view of a fourth alternative embodiment of the support device disposed on a support bed and in a support position.

Optionally, the first and second lateral bolsters 241 and 242 can be configured to provide lateral movement inward and outward relative to the vertical axis VA in directions indicated by the arrows L in FIG. 13. This type of lateral movement, versus the pivoting movement about the pivot axis PAS, can be affected via a lateral slide 244. This lateral slide can include slots 244S defined by a plate 244P. The slide also can include a tightening knob 244K. The tightening knob 244K can be joined with a threaded post that is threaded into a corresponding nut captured by vertical slide 245. When the knob is tightened, it can clamp against the plate 244P, thereby fixing the plate and the attached bolster in a particular lateral displacement relative to the vertical axis VA. Thus, a user can tighten and loosen the knob 244K to laterally move the slide 244 and thus the lateral bolster 241 inward and outward in lateral direction L relative to the vertical axis VA. The user can lock the lateral bolster in a position with the slide by tightening the knob. Of course, other mechanisms can substitute the slide and provide such lateral movement of the bolsters depending on the application.

Further optionally, the first and second lateral bolsters 241 and 242 can be configured to provide vertical movement, upward and downward, in directions Y in FIGS. 13 and 14. This type of vertical movement can be provided via a vertical slide 245. The vertical slide can include a slot 245S. The tightening knob 244K can be connected to a threaded element that extends into that slot 245S and is joined with a nut inside the slide. A user can loosen the knob 244K, and then slide or move the lateral bolster 241 up or down vertically in directions Y until an adequate vertical adjustment is achieved. The user can then retighten the knob 244K to set the vertical placement of the lateral bolster 241 relative to the patient, center bolster and/or base frame. Thus, the lateral bolsters of this embodiment can be rotationally movable, laterally movable relative to the vertical axis and/or vertically movable up-and-down. This can provide a variety of different orientations of the lateral bolsters for different patients and for different types of therapy.

Generally, the method of using the support device 210 of this embodiment to provide therapy to a patient is substantially identical to that of using the device 10 of the embodiment described above, and therefore will not be repeated in detail here.

The apparatus and methods of the current embodiments provide a support device that is well-suited for supporting a patient in upright, sitting position, particularly during physical therapy sessions. The device can be lightweight, optionally less than 20 pounds, can be easily cleaned and disinfected and is highly transportable. In use, the support device provides excellent back stabilization as well as lateral stabilization, elderly, immobilized and/or disabled patients who lack the core strength to sit in the upright position on the side of a support bed.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation (s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z, in any number of units.

The embodiments of the invention in which an exclusive property or privilege is claimed are defined as follows:

1. A method of supporting a patient for physical therapy, comprising:

providing a support device comprising a center bolster joined with first and second lateral bolsters, and a back support movably joined with the center bolster;

moving the back support from a stored mode in which the back support is adjacent the center bolster support, to a support mode in which the back support is moved away from the center bolster such that the back support is 60 degrees to 95 degrees offset from the center bolster;

placing the support device on a support bed having an upper surface;

engaging the support device with the support bed so that the support device is substantially non-slidable relative to the support bed upper surface; and positioning a patient, in need of physical therapy, on the upper surface of the support bed;

leaning the patient against the center bolster in an upright position on the support bed so that a patient force is transferred through the center bolster to the back support and thereby against the upper surface of the support bed so that the support device supports the patient in the upright position, with at least one of the first and second lateral bolsters adjacent the patient while the patient is in the upright position on the support bed, so as to engage at least one of a left side and a right side of the patient's torso if the patient starts leaning toward a side, whereby the patient is prevented from toppling to the side or rearward with the support device.

2. The method of claim 1 comprising moving the first and second lateral bolsters inward toward the patient's torso during the leaning step.

3. The method of claim 2 comprising pivoting the back support downward and away from the center bolster toward the upper surface of the support bed so that the back support engages and is parallel to the upper surface during the leaning step.

4. The method of claim 3 comprising articulating a first rigid bar and a second rigid bar relative to one another to secure the back support in a fixed position in the support mode, wherein the first rigid bar and second rigid bar are pivotally joined with one another at a pivot element located between the center bolster and the back support when the back support is in the support mode.

5. The method of claim 1, wherein a forward support extends forwardly from the center bolster, comprising moving the forward support to a position in which the forward support extends downward beside a lateral edge of the support bed.

6. The method of claim 5 comprising pivoting the forward support outward away from the center bolster.

7. The method of claim 1 comprising securing a forward support to a bed frame adjacent the support bed with a flexible elongated strap, in a fixed and immovable manner so that the support device is non-slidable relative to the support bed upper surface.

8. The method of claim 7 comprising wrapping the flexible elongated strap around the bed frame and joining an end of the strap with a body of the strap to fix a length of the strap.

9. The method of claim 1 comprising administering physical therapy to the patient while the patient is supported by the support device on the support bed.

10. The method of claim 1 comprising attaching a strap associated with a forward support arm to a bed frame located under the support bed.

11. The method of claim 1 wherein the support device is void of a seat bottom so that that patient sits atop the upper surface of the support bed without any part of the support device between a patient's seat and the upper surface of the support bed.

12. A method of supporting a patient for physical therapy, comprising:

providing a support device comprising a vertical axis, a first forward support and a second forward support extending forwardly from a center bolster disposable in an upright position, the center bolster joined with first and second lateral bolsters, and a back support pivotally joined with the center bolster;

moving the back support from a stored mode in which the back support is adjacent the center bolster, to a support mode in which the back support is pivoted away from the center bolster such that the back support lays substantially on an upper surface of a support bed;

placing the support device behind an anterior of the patient while the patient is seated in the upright position, so that the first and second forward support project adjacent at least a portion of the patient's legs, and so that the back support extends adjacent an upper surface of the support bed;

engaging the first and second forward support against the support bed;

moving a patient, in need of physical therapy, to an upright position on the support bed so that at least one leg of the patient's legs extends over a side of the support bed;

leaning the patient against the center bolster so that a patient force is transferred through the center bolster and the back support against the upper surface of the support bed so that the support device supports the patient in the upright position without the support device substantially sliding across the upper surface;

moving the first and second lateral bolsters toward the vertical axis and toward the patient while the patient is in the upright position so that at least one of the first and second lateral bolsters is positioned to engage at least one of a left side and a right side of the patient's torso if the patient starts leaning toward a side, whereby the patient is prevented from toppling to the side; and administering physical therapy to the patient while the patient is supported by the support device on the support bed.

13. The method of claim 12 wherein the center bolster is joined with a base frame including a vertical support extending parallel to a vertical axis of the support device, comprising folding the back support away from the vertical support during the moving step.

14. The method of claim 12 wherein the engaging step includes extending the first forward support with the lateral edge of the support bed and the second forward support with the lateral edge of the support bed to stabilize the support device with the center bolster being substantially vertical.

15. The method of claim 12 wherein moving the first and second lateral bolsters includes pivoting the first bolster about a pivot axis moving the first bolster vertically.

16. The method of claim 12 wherein moving the first and second lateral bolsters includes pivoting the first bolster about a pivot axis and moving the first lateral bolster inward toward a vertical axis of the support device.

17. The method of claim 12 wherein the support device is void of a seat, so that the patient in the upright position is seated on the upper surface of the support bed, rather than on a portion of the support device.

18. An apparatus to support a patient undergoing physical therapy in a seated, upright position, the apparatus comprising:

a center bolster having a vertical axis, the center bolster configured for orientation in an upright, substantially vertical position;

a forward support that extends forwardly of the center bolster;

a first lateral bolster joined with the center bolster and adapted to move inward toward the vertical axis and toward a first side of the patient's torso to provide lateral support to the patient and impair the patient from laterally toppling;

a second lateral bolster joined with the center bolster and adapted to move inward toward the vertical axis and toward a second side of the patient's torso to provide lateral support to the patient and impair the patient from laterally toppling; and a back support joined with the center bolster, the back support being movable from a stored mode in which the back support is adjacent and substantially parallel to the center bolster to a support mode in which the back support is moved away from the center bolster such that the back support lays substantially on an upper surface of a support bed, the back support configured to support the center bolster in the substantially vertical position, wherein the forward support is configured to engage the support bed to prevent the center bolster from substantially sliding across the upper surface of the support bed, over which the center bolster is disposed, wherein the center bolster and forward support cooperatively define an opening in which the patient is seated when the patient is in an upright position, the opening allowing the patient to sit directly on the upper surface of the support bed.

19. The apparatus of claim 18 wherein the first and second lateral bolsters are joined with a first lock and a second lock that selectively lock the first and second lateral bolsters in first and second angular positions, respectively, relative to the vertical axis.

20. The apparatus of claim 18 wherein the forward support is joined with the center bolster, and configured to move from a forwardly extending position to a vertical storage position.

* * * * *